US006525642B1

(12) United States Patent
Kremers et al.

(10) Patent No.: US 6,525,642 B1
(45) Date of Patent: Feb. 25, 2003

(54) SELF-REGENERATING LIQUID METAL CURRENT LIMITER

(75) Inventors: Wolfgang Kremers, Bonn (DE); Andreas Kraetzschmar, Bonn (DE); Frank Berger, Swistal-Miel (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/937,578

(22) PCT Filed: Mar. 11, 2000

(86) PCT No.: PCT/EP00/02202

§ 371 (c)(1),
(2), (4) Date: Jan. 29, 2002

(87) PCT Pub. No.: WO00/58987

PCT Pub. Date: Oct. 5, 2000

(30) Foreign Application Priority Data

Mar. 29, 1999 (DE) ..... 199 14 147

(51) Int. Cl.[7] ..... H01C 10/02

(52) U.S. Cl. ..... 338/80; 338/81; 338/82; 338/83; 338/84; 338/85

(58) Field of Search ..... 338/80, 81, 82, 338/83, 84, 85

(56) References Cited

U.S. PATENT DOCUMENTS 5,779,492 A * 7/1998 Okuyama et al. ..... 439/179

6,313,417 B1 * 11/2001 Schnell ..... 200/61.47

FOREIGN PATENT DOCUMENTS

| | | |
|---|---|---|
| DE | 373009 C | 4/1923 |
| DE | 2652506 | 5/1978 |
| DE | 4012385 | 3/1991 |
| SU | 922911 A | 4/1982 |
| SU | 1094088 | 5/1984 |

* cited by examiner

*Primary Examiner*—Karl D. Easthom
(74) *Attorney, Agent, or Firm*—Davidson, Davidson & Kappel, LLC

(57) ABSTRACT

A self-regenerating liquid metal current limiter including solid metal electrodes for connection to an electric circuit to be protected and several compression chambers which are partially filled with liquid metal. The compression chambers are located one behind the other between the electrodes and are formed by pressure-resistant insulating bodies and by partition walls with connecting channels that are supported by the insulating bodies. The partition walls are provided with a plurality of connecting channels that are not arranged in a generally concent arrangement with respect to a substantially horizontal longitudinal axis of the current limiter, the axis extending in a direction perpendicular to the partition walls. The current limiter provides for various positions of use corresponding to a position of rotation of the current limiter about its longitudinal axis.

6 Claims, 1 Drawing Sheet

A
A
1
2
3
4
5
6
7
10
11
12
51
71
81;82
81
82
83
84
t1
t2
t3

SELF-REGENERATING LIQUID METAL CURRENT LIMITER

BACKGROUND

The present invention relates to a self-recovering current-limiting device with liquids metal, including electrodes made of solid metal for the connection to an external electric circuit to be protected and several compression spaces which are partially filled with liquid metal.

Soviet Union Patent Publication SU 922 911 A describes a self-recovering current-limiting device containing two electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. In German Patent Application DE 40 12 385 A1, a current-limiting device having only one compression space is described and vacuum, protective gas, or an insulating liquid are mentioned as the medium above the liquid level. A known current-limiting device according to Soviet Union Patent Publication SU 1 094 088 A is equipped with intermediate walls in which several connecting channels are concentrically formed around, i.e., lie at a same radius from and are symmetrically disposed relative to, the longitudinal axis and with separating walls made of copper which are arranged between the intermediate walls and led outward for cooling the liquid metal. This current-limiting device permits positions of use involving rotations of up to 360 about the horizontal longitudinal axis and inclinations of up to 50 relative to the horizontal, which, however, is rendered possible only in conjunction with the separating walls, which disadvantageously carry a potential, the compression spaces having to be individually filled with liquid metal in a manner requiring too much effort because of these separating walls.

To enable the current-limiting devices mentioned at the outset to be used for different cases of application, they have to be differently designed to the effect that they do not operate in response to an overloading of more or less short duration, depending on the case of application. Thus, for example, in conjunction with generators, current-limiting devices must not operate in response to a short-time overload current which is 2 . . . 6 times the nominal current or, in conjunction with motors of poor iron quality or transformers, in response to a short-time overload current which is 6 . . . 18 times the nominal current, but have to operate only in response to a short-circuit current which in comparison is higher. Until now, therefore, there has been the disadvantageous requirement for the manufacturers to offer a considerable number of current-limiting devices to permit a suitable selection with respect to the conditions on the user side.

According to German Patent Document DE-PS 373 009 a switch in which the contact is made via liquid metal which partially fills the interior and the switching body is provided with a perforated dividing wall which separates the liquid metal. The connecting channels in the dividing wall are uniformly arranged on a reference circle which is concentric with respect to the longitudinal axis of the switch. The two parts of the liquid metal are connected via an adjustable channel cross-section, the adjustment being effected by a rotation about the longitudinal axis of the switch. After a certain quantity of electricity has passed through, the liquid metal in the channel vaporizes and interrupts the current while at the same time a tripping solenoid restores the switch to the non-conducting original position so that the readiness of the switch is attained again only after a new rotation to be effected from outside. This switch has to be reset to the service position using an external device after the current-limiting event has occurred. Secondly, the switch uses a uniformly concentric arrangement of connecting channels. Thirdly, a regulating device, for example, a regulating screw, are required for adjusting a minimum trip current.

SUMMARY OF THE INVENTION

The present invention provides a self-recovering current-limiting device with liquid metal. The device includes a first and a second electrode for connection to an electric circuit to be protected, each of the first and second electrodes being made of a respective solid metal. A plurality of pressure-resistant insulating bodies and a plurality of insulating intermediate walls supported by the plurality of insulating bodies are also provided. The plurality of insulating intermediate walls and the plurality of pressure-resistant insulating bodies define a plurality of compression spaces, the plurality of compression spaces being disposed one behind the other between the first and second electrodes and being at least partially filled with the liquid metal. The plurality of insulating intermediate walls define a longitudinal axis extending perpendicularly thereto in a generally horizontal direction and each define a plurality of connecting channels disposed generally non-concentrically relative to the longitudinal axis so as to enable a plurality of positions of use of the current-limiting device to be achieved by turning the current-limiting device about the longitudinal axis, a different current-limiting characteristic being provided in each of the positions of use.

By deliberately installing the current-limiting device in different positions of use, the liquid metal, because of its fluid properties, adapts to the then resulting specific inner spatial geometry of the current-limiting device. It was found that the magnitude of the response, or minimum trip, current increases with increasing filling level of the liquid metal above the connecting channels, provided that the remaining conditions are identical.

Depending on the design and arrangement of the connecting channels, different immersion depths and/or a different number of connecting channels situated below the liquid level ensue.

In an embodiment of the present invention, in one of the positions of use, all connecting channels are situated above the liquid level. By a rotation into this position of use from another position of use or vice versa, the current-limiting devices additionally acts as an on-off switch.

The current-limiting device may be provided with an indicating device assigned to its positions of use and which provides unequivocal information on the current-limiting characteristic of the specific position of use.

GaInSn alloys as the liquid metal to be used are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

BRIEF DESCRIPTION OF THE DRAWINGS

Further details and advantages of the present invention ensue from the following exemplary embodiment which will be explained in the following on the basis of Figures.

DETAILED DESCRIPTION

Figures 1, 2A, 2B, 2C, 2D:
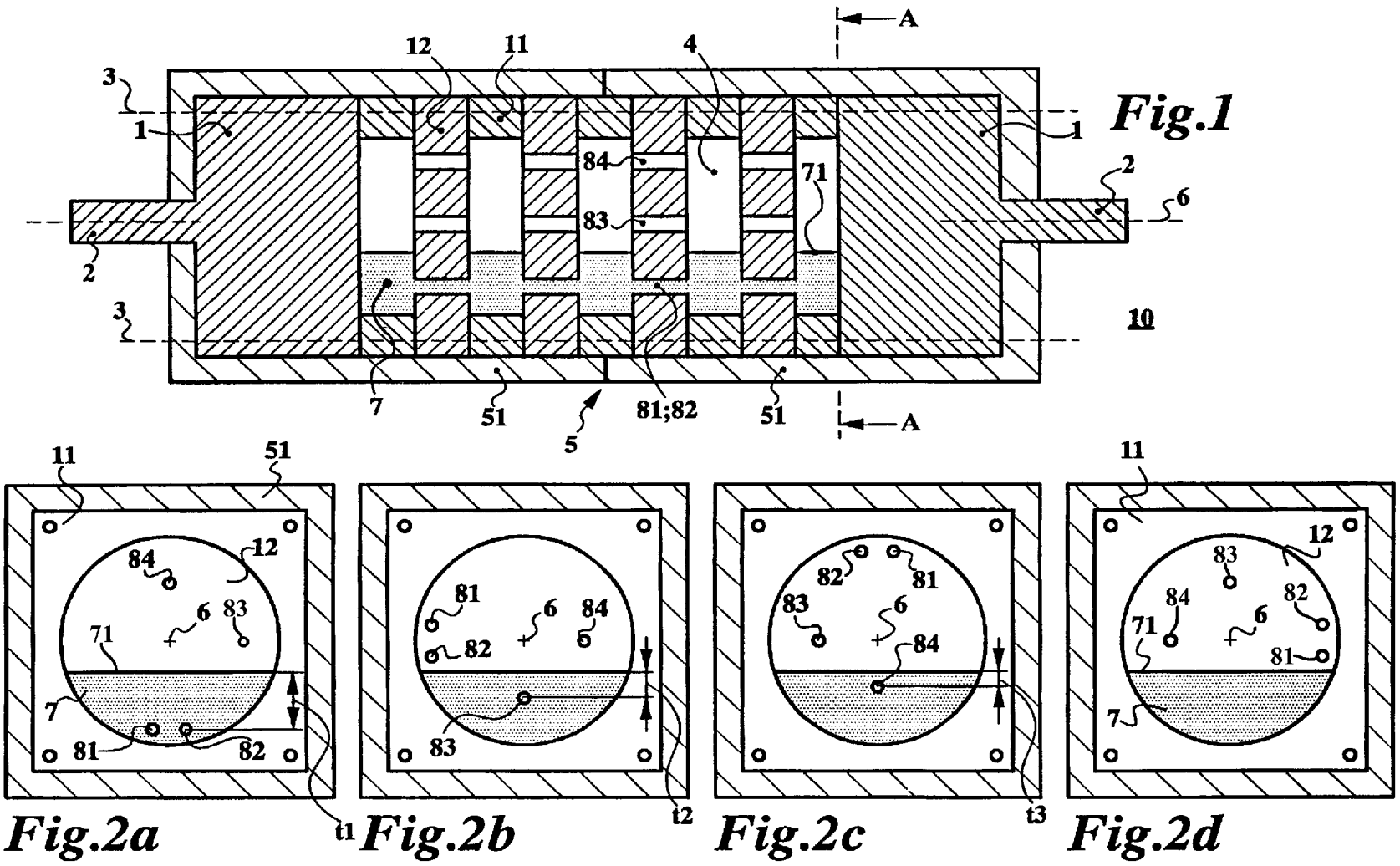
FIG. 1 shows a longitudinal section of a current-limiting device according to the present invention.
FIGS. 2*a,b,c,d* show the current-limiting device of FIG. 1 in different positions of use, in each case in cross-section A—A according to FIG. 1.

According to FIG. 1, current-limiting device 10 contains one electrode 1 made of solid metal, preferably of copper, on each of the two sides, the electrode having a cuboidal design with a square cross-section and merging into an outer connecting conductor 2. Located between electrodes 1 are a plurality of compression spaces 4 which are formed by a corresponding number of ring-shaped sealing disks 11 and insulating intermediate walls 12. Electrodes 1, sealing disks 11, and intermediate walls 12 are supported by a molded housing 5, known devices being provided for sealing compression spaces 4 and frictionally connecting elements 1, 11 and 12 which are supported in molded housing 5, however, the known devices not being shown for reasons of clarity. The devices for sealing can be, for example, sealing rings between sealing disks 11 and intermediate walls 12 or electrodes 1. The devices for frictionally connecting are, for example, continuous clamping bolts along the two lines 3. The two outer compression spaces 4 are each laterally bounded by one of electrodes 1 and by an intermediate wall 12. Inner compression spaces 4 are each laterally bounded by two intermediate walls 12. Molded housing 5 which is composed of two substantially identical half shells 51 as well as sealing disks 11 are pressure-resistant first and second insulating bodies. All compression spaces 4 are partially filled with a liquid metal 7, for example, a GaInSn alloy. In this example, vacuum or a protective gas are located above liquid level 71. Intermediate walls 12 are provided with connecting channels 81 through 84. If at least one of connecting channels 81 through 84 is also filled, or at least partially filled, with liquid metal 7, a continuous electrically conductive connection exists between electrodes 1.

According to FIGS. 2*a*–2*d*, intermediate walls 12 are each provided with four connecting channels 81 through 84. Horizontally running longitudinal axis 6 of current-limiting device 10 extends in a direction perpendicular to intermediate walls 12. Not all of connecting channels 81, 82, 83 and 84 are concentrically arranged with respect to longitudinal axis 6. According to FIG. 2*a* through FIG. 2*d*, current-limiting device 10 has four different positions of use, which ensue consecutively by turning current-limiting device 10 in each case by 90° about its longitudinal axis 6. In the positions of use according to FIGS. 2*a* through 2*c*, the connecting channels 81, 82, or 83 or 84 reached, or at least partially filled, by liquid metal 7 each have different immersion depths t1 or t2 or t3 with respect to liquid level 71, namely in decreasing order. In the position of use according to FIG. 2*a*, the two connecting channels 81 and 82 are reached by liquid metal 7. In each of the positions of use according to FIG. 2*b* and FIG. 2*c*, one connecting channel, namely connecting channel 83 or connecting channel 84, is reached by liquid metal 7, respectively. In the position of use according to FIG. 2*d*, none of connecting channels 81 and 84 is reached by liquid metal 7. Because of the different immersion depths t1 through t3 and the different number of connecting channels 81 through 84 reached by liquid metal 7 in the four positions of use shown, four different characteristics are attained for one and the same current-limiting device 10. Thus, in the individual positions of use, for example, current-limiting device 10 takes on a current-limiting characteristic which

- in FIG. 2*a*, is suitable for motor protection with a nominal current factor of six to fourteen,
- in FIG. 2*b*, is suitable for the protection of cables and installations with a nominal current factor of six to twelve,
- in FIG. 2*c*, is suitable for generator protection with a nominal current factor of two to six, and
- in FIG. 2*d*, for lack of a connecting channel reached with liquid metal 7, is suitable for a permanently open-circuit OFF position.

The present invention is not limited to the specific embodiments described above but includes all variations within the scope of the appended claims. Thus, for example, the current-limiting characteristics in the different positions of use can be further modified by using connecting channels having different channel diameters. Markings on the exterior walls of molded housing 5 can serve for unequivocally assigning a current-limiting characteristic to the respective position of use according to FIGS. 2*a* through 2*c* and for assigning the OFF position to the position of use according to FIG. 2*d*.

What is claimed is:

1. A self-recovering current-limiting device with liquid metal, the device comprising:

a first and a second electrode for connection to an electric circuit to be protected, each of the first and second electrodes being made of a respective solid metal;

a plurality of pressure-resistant insulating bodies; and a plurality of insulating intermediate walls supported by the plurality of insulating bodies;

wherein the plurality of insulating intermediate walls and the plurality of pressure-resistant insulating bodies define a plurality of compression spaces, the plurality of compression spaces being disposed one behind the other between the first and second electrodes and being at least partially filled with the liquid metal; and wherein the plurality of insulating intermediate walls define a longitudinal axis extending perpendicularly thereto in a generally horizontal direction and each define a plurality of connecting channels, at least two of the plurality of connecting channels being disposed on a different radius relative to the longitudinal axis so as to enable a plurality of positions of use of the current-limiting device to be achieved by turning the current-limiting device about the longitudinal axis, a different current-limiting characteristic being provided in each of the positions of use.

2. The self-recovering current-limiting device as recited in claim 1 wherein in at least a first of the plurality of positions of use at least a first of the plurality of connecting channels is at least partially filled by the liquid metal at a first immersion depth relative to a liquid level of the liquid metal and in at least a second of the plurality of positions of use at least a second of the plurality of connecting channels is at least partially filled by the liquid metal at a second immersion depth relative to the liquid level of the liquid metal, the first and second immersion depths being different.

3. The self-recovering current-limiting device as recited in claim 1 wherein in at least a first of the plurality of positions of use a first number of the plurality of connecting channels is at least partially filled by the liquid metal and in at least a second of the plurality of positions of use at least a second number of the plurality of connecting channels is at least partially filled by the liquid metal, the first and second numbers being different.

4. The self-recovering current-limiting device as recited in claim 1 wherein in a first of the plurality of positions of use none of the plurality of connecting channels is at least partially filled by the liquid metal.

5. The self-recovering current-limiting device as recited in claim 1 further comprising an indicating device configured for indicating a respective current-limiting characteristic of each of the plurality of positions of use.

6. The self-recovering current-limiting device as recited in claim 1 wherein the liquid metal includes an alloy of GaInSn.

* * * * *